United States Patent [19]

Blatter et al.

[11] Patent Number: 4,997,002

[45] Date of Patent: Mar. 5, 1991

[54] POWER TRANSMISSION

[75] Inventors: Albert Blatter, Highland; Robert E. Davis, Linden, both of Mich.

[73] Assignee: Vickers, Incorporated, Troy, Mich.

[21] Appl. No.: 497,393

[22] Filed: Mar. 22, 1990

[51] Int. Cl.[5] ..... F15B 13/044

[52] U.S. Cl. ..... 137/82; 137/85; 137/625.62; 335/230

[58] Field of Search ..... 137/82, 85, 625.62; 335/230

[56] References Cited

U.S. PATENT DOCUMENTS 4,741,365 5/1988 Van Ornum ..... 137/628.65

4,794,941 1/1989 Godon ..... 137/82

*Primary Examiner*—Gerald A. Michalsky

*Attorney, Agent, or Firm*—Barnes, Kisselle, Raisch, Choate, Whittemore & Hulbert

[57] ABSTRACT

An electrohydraulic servovalve comprising a torque motor which receives an electrical signal and position a flapper of a spring tube and flapper subassembly between a pair of opposed nozzles to control a spool valve and includes a feedback spring connected to the flapper and to the spool of the spool valve. A method of obtaining torque motor air gap symmetry is provided which comprises forming the pole piece/magnet subassembly to provide a desired total pole air gap on both ends of the armature, forming the armature ends so that they are equal to the total pole gap minus twice the desired nominal air gap, assembling the torque motor before attaching the spring tube and flapper subassembly, positioning the spring tube and flapper subassembly and the pole piece/magnets in a relative position to one another, providing spacers between the lower edges of the armature and the gap of the pole pieces, providing wedges between the upper surfaces of the ends of the armatures and the gap of the upper pole piece, providing a joint between the tube and the armature by a hardenable material to bond the armature and the spring tube, and permitting the joint to harden and set.

3 Claims, 2 Drawing Sheets

POWER TRANSMISSION

This invention relates to electrohydraulic servovalves of the type comprising a first stage torque motor and a spool valve.

BACKGROUND AND SUMMARY OF THE INVENTION

One common type of electrohydraulic servolvalve comprises a torque motor which receives an electrical signal and positions a flapper between a pair of opposed nozzles to control a spool valve and a feedback spring connected to the flapper and to the spool of the spool valve.

Such servovalves are normally configured to contain a pilot stage and a power stage. The pilot stage is the portion of the valve which converts an electrical signal to mechanical motion and the power stage is the portion which amplifies the pilot stage power to a practical level. The pilot stage is a sensitive and precisely manufactured device. The device contains four air gaps commonly called the upper pole gaps and the lower pole gaps. It is very important that these gaps are manufactured to be equal to each other as well as to a specific size for the particular torque motor under construction. A typical size for the gap is 0.010 to 0.015 inches with all four gaps ideally within 0.0005 inches of each other. Although it is slightly less than ideal, it is acceptable to have the lower gaps equal to each other and the upper gaps also equal to each other, but the lower gaps may be slightly (0.001 inches) different than the upper gaps. There are a large number of parts that ultimately determine the gap dimension. It is thus not practical to hold the critical dimensions close enough to provide the necessary gap control.

One solution to the problem is to grind the total air gap to a specific dimension for the magnet and pole piece subassembly. The armature ends are ground to a dimension equal to the total pole gap minus two times the desired air gap. The torque motor is assembled and the resulting air gaps are observed. Shims are then replaced with other shims which will bring the air gaps to the desired uniformity by shifting the entire pole piece/magnet subassembly.

A second solution to the problem which has been proposed is to completely assemble the torque motor with parts such that all the gaps are smaller than desired, but not zero, and EDM processing all the gaps at one time. This process still requires fairly close tolerance control of many parts and may also require some shim adjustment for minor correction.

Among the objectives of the present invention are to provide a method of assembly which obviates the problems in the prior art.

In accordance with the invention, the armature is assembled on the spring tube/flapper subassembly of the torque motor and the joint between the armature and the flapper subassembly comprises a one part, heat cured thermosetting adhesive.

More specifically, the method of obtaining torque motor air gap symmetry is provided which comprises forming the pole piece/magnets subassembly to provide a desired total pole air gap on both ends of the armature, forming the armature ends so that they are equal to the total pole gap minus twice the desired nominal air gap, assembling the torque motor before attaching the armature to the spring tube/flapper subassembly, positioning the armature on the spring tube/flapper subassembly and the pole piece/magnet subassembly in a relative position to one another by providing spacers between the lower edges of the armature and the gap of the pole pieces, providing wedges between the upper surfaces of the ends of the armatures and the gap of the upper pole piece, providing a joint between the tube and the armature by a hardenable material to bond the armature and the spring tube subassembly, and permitting the joint to harden and set.

DESCRIPTION

Figure 1:
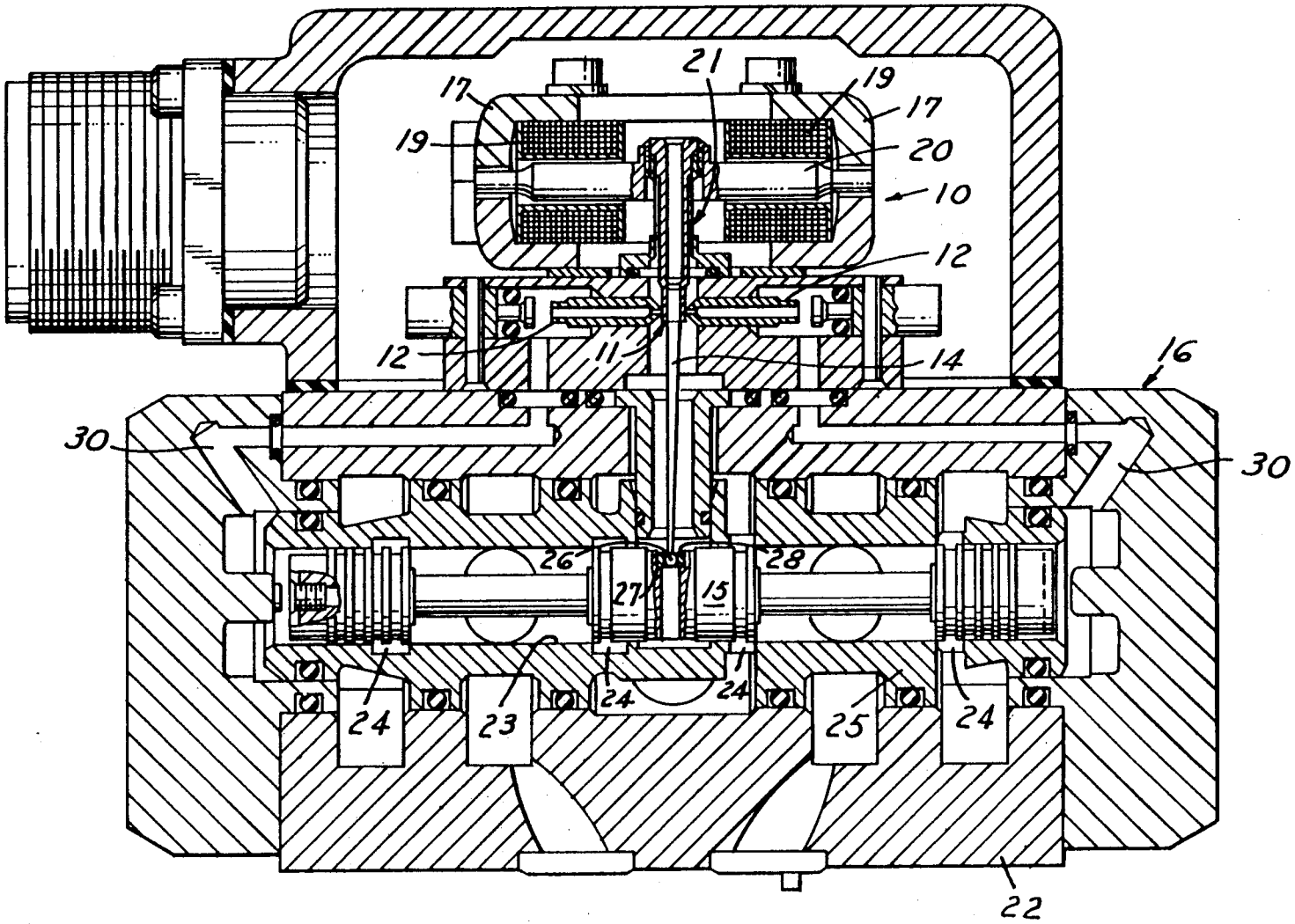
FIG. 1 is a sectional view of a servovalve embodying the invention.

Referring to FIG. 1, the invention relates to servovalves of the type comprising a first stage torque motor 10 which receives an electrical signal and positions a flapper 11 between a pair of opposed nozzles 12 to control a spool valve and includes a feedback spring 14 connected to the flapper 11 and to the spool 15 of a spool valve 16.

Specifically in such servovalves, the torque motor comprises a motor that includes pole pieces 17, permanent magnets 18, and coils 19 having openings therein. An elongated armature 20 is positioned with its ends projecting between the pole pieces. The flapper/armature subassembly is in the form of a spring tube 21 and is fixed in an opening in the armature 20 and projects transversely thereto. The flapper 11 is, in turn, fixed to the tube 21 and projects between two nozzles 12 in a nozzle block.

The torque motor is mounted on the housing 22 of a spool valve 16 which is shown as comprising a four-way closed center spool 15 sliding in a bore 23 and adapted to uncover openings 24, in a sleeve in the bore 23 to meter flow to control ports. Positioning of the spool 15 relative to the metering slots provides precision controlled flow. The feedback spring 14 is mounted on the flapper and includes a ball 26 that extends into an opening 27 in an insert 28 in the spool 15.

When an input signal is applied to the coils 19, the armature 20 ends are polarized creating a rotational torque on the armature 20. The tube 21 acts as a spring centering the flapper motion between the two nozzle openings 12. As the flapper 21 moves toward one nozzle or another, a pilot flow (pressure differential) is supplied which is applied through passages 30 to one end or the other of the spool 15 to position the spool 15. As the spool moves, the feedback spring 14 bends and applies a force to the flapper 11 which tends to recenter the flapper 11 between the nozzles 12. Positioning of the spool occurs at the point in which the spring feedback force equals the torque motor force induced by the input current. The spool stops at this position and the flapper 11 is essentially centered until the input current changes to a different level. With constant supply pressure, output control flow is proportional to the input current. Such construction is old and well known.

In accordance with the invention, the flapper is connected to an armature of the torque motor by a joint between the armature and the flapper comprising a hardenable material, a one part, heat cured thermosetting adhesive.

Figure 2:
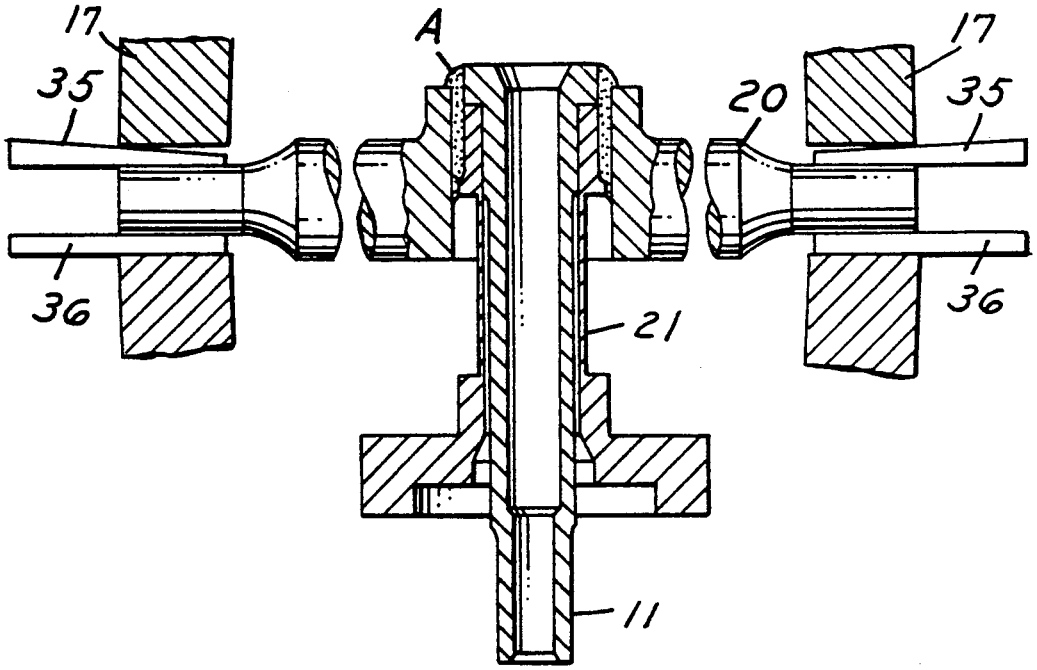
FIG. 2 is a fragmentary sectional view showing the method of assembly of a portion of the servovalve in accordance with the invention.

The pole piece/magnet subassembly is ground to provide the desired total pole air gap on both ends of the armature 20 and the armature thickness at the ends is ground to be equal to the total pole gap minus twice the desired nominal air gap. The completed torque motor is then assembled with the exception that the armature 20 is not permanently attached to the flapper. The spring tube and flapper subassembly and the pole piece/magnet subassembly are now assembled as shown in FIG. 2 to a fixture or nozzle block without shims or spacers. Two identical spacers 36 are provided between the armature and the lower pole piece spaces producing the desired gap thickness. The upper shims 35 are in the form of wedges to provide the clamping force necessary to hold the armature in place. The joint between the armature and flapper spring/spring tube is now completed by the desired adhesive such as an epoxy type material. Although an adhesive is preferred, other joint finishing alternatives may be used such as soft solder, injected metal, and the like.

The use of the one part, heat curing, thermosetting plastic adhesive A is preferred.

The process comprises:

positioning the spring tube and flapper subassembly and the pole piece/magnets in a relative position to one another, providing spacers between the lower edges of the armature and the gap of the pole pieces, providing wedges between the upper surfaces of the ends of the armatures and the gap of the upper pole piece, providing a joint between the tube and the armature by a hardenable material to bond the armature and the spring tube, and permitting the joint to harden and set.

What is claimed:

1. A method of obtaining torque motor air gap symmetry is provided which comprises forming a pole piece/magnets subassembly having upper and lower pole pieces including a gap, and an armature which has ends, lower edges and upper surfaces on the ends to provide a desired total pole air gap on both ends of the pole piece/-magnets subassembly, forming the armature ends so that they are equal to the desired total pole gap minus twice the desired nominal air gap, forming a spring tub/flapper subassembly, assembling the torque motor before attaching the armature to the spring tube/flapper subassembly, positioning the spring tube/flapper subassembly and the pole piece/magnets in a relative position to one another, providing spacers between the lower edges of the armature and the gap of the pole pieces, providing wedges between the upper surfaces of the ends of the armatures and the gap of the upper pole piece, and providing a joint between the tube and the armature by a hardenable material to bond the armature and the spring tube/flapper subassembly and providing conditions which will harden and set the joint.

2. The method set forth in claim 1 wherein said step of providing a joint comprises applying a one part, thermosetting adhesive between the spring tube/flapper subassembly and the armature.

3. The method set forth in claim 2 wherein said thermosetting adhesive comprises an epoxy type material.

* * * * *